United States Patent [19]

Ryabchikov et al.

[11] 4,155,753

[45] May 22, 1979

[54] PROCESS FOR PRODUCING SILICON-CONTAINING FERRO ALLOYS

[76] Inventors: Ivan V. Ryabchikov, ulitsa Bocharova, 16, kv. 51; Nikolai M. Dekhanov, prospekt Lenina, 190, kv. 26, both of Zaporozhie, U.S.S.R.

[21] Appl. No.: 870,502

[22] Filed: Jan. 18, 1977

[51] Int. Cl.[2] ..... C22C 33/04; C22B 4/06

[52] U.S. Cl. ..... 75/129; 75/10 R

[58] Field of Search ..... 75/10–12, 75/129

[56] References Cited

U.S. PATENT DOCUMENTS 3,276,859 10/1966 Collin ..... 75/11

3,759,695 9/1973 Downing ..... 75/10 R

*Primary Examiner*—P. D. Rosenberg

*Attorney, Agent, or Firm*—Fleit & Jacobson

[57] ABSTRACT

A continuous one-stage process for producing silicon-containing ferro alloys consists in making up of a charge comprising quartzite and a briquetted mixture of an ore carrying an alloying element of the alloy to be produced with a carbonaceous reducing agent comprising a carbon content 1.03 to 1.25 times as low as that sufficient for the reduction of all the elements in the charge, and 2 to 15 times as high as that sufficient for the reduction of the alloying element and subsequent smelting the resultant charge in a smelting furnace.

2 Claims, No Drawings

PROCESS FOR PRODUCING SILICON-CONTAINING FERRO ALLOYS

The present invention relates to the manufacture of ferro alloys, and more particularly to a process for producing silicon-containing ferro alloys such as Si-Ba, Si-rare earth metals and others which are utilized for deoxidizing, modifying, and alloying cast iron and steel.

BACKGROUND OF THE INVENTION

Of the most widely used industrial processes for producing silicon-containing ferro alloys there can be named three:

1. A metallothermic process wherein an alloying element is reduced by aluminium and/or by ferro silicon made by electrolysis or electric smelting respectively in individual furnaces.

A disadvantage of this process resides in the fact that smelting is carried out periodically in two or three stages with the use of high cost reducing agents. Moreover, the application of this process involves considerable losses (up to 50%) of the alloying elements with slag.

Reprocessing of the slag is a complicated scientific and technological problem.

In addition, the slags formed in the process of casting, for instance alloys with barium, contain toxic compounds, and they have to be kept in special containers.

2. A carbothermic two-stage process, wherein silicon and the alloying elements are reduced by a carbonaceous reducing agent such as coke or coal, in the presence of a semi-product obtained in another smelting furnace and containing alloying element carrying carbides.

A disadvantage of this process resides in the fact that the reduction is carried out in two stages. Preserving and reprocessing of carbides contained in the semi-product, such as carbides of rare earth and alkaline earth metals, involve considerable difficulties, unsatisfactory production conditions (fire safety and explosion proofness), and a rather high consumption of energy and materials.

3. A carbothermic one-stage process, wherein the reduction of silicon and alloying element is carried out in one smelting furnace. Theoretically, this process is the most feasible of all the three. However, numerous attempts of the application thereof for smelting certain alloys containing rare earth, alkaline and other metals difficult to reduce, met considerable difficulties in connection with slagging or formation of deposits in a furnace smelting chamber. This resulted in a sharp deterioration of the alloy quality as well as of all production and economic figures.

To hinder the reactions causing an accumulation of carbides in the furnace, the quantity of carbon in the charge should not exceed a stoichiometric one and the same should be uniformly distributed throughout the volume of the furnace. However this condition is difficult to realize when utilizing briquetted charge with different bulk weights of individual components. This being the case, there are formed complex oxidic compounds on the furnace top, in particular silicates, when metal oxides interact with silica (primary slag formation).

One of the possible ways of intensifying reduction of metals is milling and subsequent briquetting of all the components of the charge. The mixing and briquetting of all the components of the charge does not preclude the possibility of slag formation, since together with improved kinetic conditions of metal reduction there grows a contacting surface of oxide forming thermodynamically stable chemical compounds.

To preclude slag formation in smelting silicon containing ferro alloys, it has been proposed to separately form briquettes from a mixture of sandy quartz with coal as disclosed in British Pat. No. 1051809.

However, these conditions contribute to extremely quick development of the reactions of forming gaseous silicon monoxide —(at 1727° C. and $P_{SiO}=1.19$ atm) and silicon carbide leading to the loss of silicon and to deposit formation in the smelting chamber of the furnace.

In addtion, due to the advancing reduction of silicon there arise conditions for participation thereof in reducing the alloying element in each reaction involving the formation of secondary silicates.

Also, known in the art is a process for producing silicon containing ferro alloys Fe-Si-Al and Fe-Si-Gr-Al disclosed in USSR Inventor's Certificate No. 273236. This process consists in a continuous one-stage carbothermic reducing the elements of the charge comprising quartzite and briquetted mixture of an alumina containing raw material with a carbonaceous reducing agent wherein a carbon content is 1.5–2 times as high as that sufficient for aluminium to be reduced.

In addition, as has been stated this process can be applied only for alloys Fe-Si-Al, wherein a content of aluminium is 25% and a content of silicon up to 20%. The realization of this method involves the following difficulties:

A continuous slagless process of smelting can not be realized on account of an indefinite carbon content contained in the whole of the charge with due regard for the reduction of silicon from quartzite.

Specifically, the excess of carbon in the charge eliminates the formation of slag but the furnace smelting chamber inevitably gets laid down with carbide deposits. And as a result smelting is to be stopped. A decrease in the charge carbon content beyond a certain amount eleminates the formation of deposits but causes the formation of slag and a decrease in reducing the elements into the alloy. As a consequence, the carbothermic one-stage process is now used for smelting but some ferro alloys, such as silicomaganese, silico-calcium, all cases being characterized by a higher or lower amount of slag formed in the process.

The smelting of silicocalcium is rather power-consuming —(the temperature of the process is more than 2000° C.) and labour-consuming and has not undergone any major improvements during last 20–30 years. Because of the deposits which are formed in the furnace and which consist mainly of carbides and silicates, the smelting of silico-calcium is carried out during short intervals, for instance 3 or 4 months. Thus obtained alloys contain inclusions of a carbide slag and tend to disintegrate into powder on exposure to air.

Absence of adequate processes for producing silicon-containing ferro alloys restricts their application in metallurgy and foundry practice, thereby hindering the extensive usage of advanced production methods.

To overcome the above-described difficulties it is necessary to carry out the process so as to simultaneously meet the opposite requirements that there should be a certain excess of a carbon content to prevent the formation of silicates and a certain defficiency thereof to completely disintegrate the carbides.

SUMMARY OF THE INVENTION

The principal object of the present invention is to provide a process for producing silicon-containing ferro alloys which excludes the formation of slag and excess carbides.

Another object of the present invention is to provide a process for producing silicon-containing ferro alloys which ensures a higher concentration of alloying elements in alloys and more complete reduction of the alloying elements from a raw material.

Still another object of the present invention is to provide a process for producing silicon-containing ferro alloys which makes it possible to carry out smelting at lower temperatures, thereby decreasing the power consumption while carrying out the process.

An additional object of the present invention is to provide a process for producing silicon-containing ferro alloys which can be used for producing a wider variety of commercial grade alloys.

These and other objects of the invention are achieved by the provision of a process comprising the following steps in the sequence set forth: preparing a charge including an ore carrying an alloying element of the alloy to be produced, a carbonaceous reducing agent and quartzite, the steps of preparing said charge consisting in making up a mixture of the ore and the carbonaceous reducing agent, subsequently briquetting this mixture, adding said quartzite to the briquetted mixture of the ore and the carbonaceous reducing agent, charging the resultant charge into a smelting furnace and subsequently carrying out a continuous one-stage reduction of the alloying element of the alloy to be produced.

This process is characterized by a deficiency of the carbon content in the carbonaceous reducing agent this deficiency being 1.03 to 1.25 times as low as that sufficient for the reduction of all the elements in the charge, and an excess of the carbon content, this excess being 2 to 15 times as high as that sufficient for the reduction of the alloying element.

According to the process of the present invention, the reduction is carried out at the temperature not exceeding 2000° C., the carbon content being 1.25 times as low as that sufficient for the reduction of all the elements in the charge, and 15 times as high as that sufficient for the reduction of the alloying element.

To put it in other words, in the process for producing silicon-containing ferro alloys the above contradiction is countered by using the charge comprising quartzite and a briquetted mixture of an alloying element with a carbonaceous reducing agent, the charge components being taken in a predetermined ratio.

To suppress slagging and intensive formation of the carbides of the alloying element a solid carbon content in the briquetted mixture should be, depending on the alloy composition, 2 to 15 times as high as that sufficient for the reduction of the alloying element in the briquetted portion of the charge.

On the other hand, to completely prevent formation of the carbide deposits in the smelting chamber of the furnace, the charge should contain either an excess of silica content or a deficiency of a solid carbon content. As production experiments have shown, the solid carbon content in the charge should run from 75 to 97% of the content sufficient, according to a stoichiometric calculation, for the reduction of all the elements in the charge including contained in silicon. Any excess in the above carbon content results in the inevitable formation of deposits in the furnace. The higher the temperature sufficient to completely reduce the elements in the charge, the higher the excess of oxygen in the briquetted portion of the charge should be and vice versa, the lower in the whole of the charge. In compliance with thermodynamic calculations and kinetic investigations the process temperature while producing ferro alloys containing rare earth and alkaline earth elements according to the process of the present invention, is 200° to 300° C. lower than that of the conventional processes for producing such ferro alloys. The fundamental reactions proceeding at a lower temperature make for the reduction of the elements constituting a ferro alloy at a lower power consumption and a decrease in amounts of these elements being lost by evaporation.

Thus, the carbon content in the carbonaceous reducing agent 1.03 to 1.25 times as low as that sufficient for the reduction of all the elements in the charge and 2 to 15 times as high as that sufficient for the reduction of the alloying element makes it possible to substantionally eliminate the formation of slag and deposits in the smelting chamber of the furnace.

This process allows for the production of alloys of Si-rare earth metals from any oxidic rare earth raw material with 30 to 45% concentration of rare earth metals in an alloy and 95 to 97% extraction of rare earth metals from the raw material. The cost of the rare earth metals in the alloys thus produced is 30 to 40% lower than that in the alloys produced by the carbothermic or methallothermic processes.

Alloys containing rare earth metals are stable to a prolonged exposure to humid air, do not require special storage and delivery precautions and easily disintegrate into pieces of a required size. As opposed to misch metal, the introduction of these ferro alloys into steel or cast iron is not accompanied by a pyroeffect. This fact as well as the possibility of milling the ferro alloys makes it possible to vary the methods of their introduction at the final stages of smelting and pouring metal. This being the case, the rare earth metals are distributed throughout the metal being smelt more uniformly than while using such ferro alloys as misch metal.

Also, the process of the present invention allows for the production of silico-barium (20 to 40%) with the high (higher than 90%) reduction of barium into the alloy as well as for the utilization of cheap sulphatic ores and concentrates. As compared to smelting experimental lots of silicobarium (8 to 12% Ba) by the metallothermic process, the cost of barium in silicobarium of the carbothermic process is decreased by 10 to 15 times. The absence of barium provides for required sanitary-and-hygienic production conditions.

When producing castings from grey pig iron, the use of silicobarium as a modifying additive makes is possible to use puddling iron in the charge instead of foundry cast iron, prevents fractures in thin cross-sections of the castings and excludes heat treatment thereof.

This process can be used for producing both traditional and new ferro alloys utilized in deoxidating, modifying and alloying steel and cast iron, for instance binary alloys (Si-Cr, Si-Mn, Si-Ca, Si-Sr, Si-Ba, Si-Al, Si-V, Si-rare earth metal and others), ternary alloys (Si-Cr-Mn, Si-Ca-rare earth metal, Si-Mn-Al, Si-Cr-Al and others), quarternary alloys (Si-Ca-Ba-Mn and others).

The nature of the invention will become clear from the following description of specific examples illustrating the process of the present invention.

EXAMPLE 1

In producing silicomanganese there were used a manganese concentrate, gas coal and quartzite as the charge materials. The manganese concentrate in an amount of 65 kg and coal in an amount of 35 kg were milled in a ball mill to a maximum particle size of 2 mm, whereupon they were mixed, and the resultant mixture was briquetted.

The briquettes thus produced were mixed with rock quartzite in an amount of 10 kg and particle size of 20 to 40 mm, and the resultant charge was charged into an electric-arc furnace of 1600 kW. Carbon content in the briquetted mixture was 2 times as high as that sufficient for the reduction of manganese, and 1.03 times as low as that sufficient for the reduction of all the elements in the charge including silicon of quartzite.

The smelting process was carried out continuously, the voltage and current intensity being 70 to 75 V and 6 to 8 KA respectively. The tapping of the alloy was carried out every 2 hours and 40 minutes into a slag pot charged with sand. Neither formation of slag nor of carbide deposits were observed in the smelting process.

The final alloy resulting from the process was found to consist of (weight %):

| Mn | Si | P | Fe, Ca, Al, C |
|---|---|---|---|
| 61.7 | 28.4 | 0.3 | Balance |

The extraction of manganese into the alloy was found to be 91%.

EXAMPLE 2

The smelting of silicon-containing ferro alloys was carried out in the same furnace from a charge comprising quartzite in amounts of 55 kg with particle size of 20 to 40 mm, and briquettes consisting substantionally of 100 kg of oxidic concentrates of the cerium group and 210 kg of coal. Carbon content in the briquettes was 11.4 times as high as that sufficient for the reduction of rare earth metals and 1.06 times as low as that sufficient for the reduction of all the elements in the charge. Neither slag nor deposits were observed to be formed during the smelting process.

The final alloy resulting from the process was found to consist of (weight %):

| rare earth metals | Si | Fe | Ca, Al, C, P |
|---|---|---|---|
| 38.0 | 54.0 | 4.1 | Balance |

The extraction of the rare earth metals into the alloy was found to be 97%.

EXAMPLE 3

The smelting of silicon-containing ferro alloys was carried out in the same furnace from a charge comprising quartzite in amounts of 86 kg with particle size of 20 to 40 mm, and briquettes consisting substantionally of 130 kg of limestone and 150 kg of coal. Carbon content in briquettes was 6 times as high as that sufficient for the reduction of calcium and 1.05 times as low as that sufficient for the reduction of all the elements in the charge. The smelting process was accompanied by formation of a small amount of slag (slag ratio 0.1). No deposits were observed to be formed. An alloy temperature at furnace tap according to four measurements was 1800 to 1900° C. (in prior art smelting procedure the temperature is 2000 to 2200° C.). The tapping of the alloy was carried out every 2 hours and 40 minutes.

The final alloy resulting from the process was found to consist of (weight %):

| Ca | Si | Fe | Al, C, S, |
|---|---|---|---|
| 31.0 | 60.0 | 6.0 | Balance |

The extraction of calcium into the alloy was 85%.

EXAMPLE 4

The smelting of silico-barium was carried out in the same furnace from a charge comprising quartzite in amounts of 75 kg with particle size 20 to 40 mm, and briquettes consisting substantionally of 93 kg of barytic concentrate and 130 kg of coal. A carbon content in briquettes was 10 times as high as that sufficient for the reduction of barium from sulphate and 1.06 times as low as that sufficient for the reduction of all the elements in the charge. Neither slag nor deposits were observed to be formed in the smelting chamber of the furnace. The tapping of the alloy was carried out every 2 hours and 40 minutes.

The final alloy resulting from the process was found to consist of (weight %):

| Ba | Si | Fe | S | Ca, Al, C |
|---|---|---|---|---|
| 36.0 | 55.0 | 4.1 | 0.08 | Balance |

The extraction of barium into the alloy was 93%.

EXAMPLE 5

The smelting of silicoyttrium was carried out in a furnace of 160 kV rating from a charge comprising quartzite in amounts of 35 kg with particle size 18 to 15 mm, and briquetts including 10 kg of yttrium oxide and 40 kg of coal. A carbon content in the briquetts was 15 times as high as that sufficient for the reduction of yttrium and 1.25 times as low as that sufficient for the reduction of all the elements in the charge. Neither formation of slag nor of deposits were observed in the smelting process.

The final alloy resulting from the process was found to consist of (weight %):

| Y | Si | Fe | Ca, Al, C |
|---|---|---|---|
| 18.0 | 68.0 | 9.7 | Balance |

The extraction of yttrium into the alloy was found to be 90%.

CONCLUSIONS

As compared to the prior art, the proposed process for producing silicon containing ferro alloys is characterized by the following:

1. The smelting process takes place continuously during one stage and without formation of either slag or carbide deposits in the smelting chamber of the furnace. 2. The temperature of the smelting process is comparatively low. 3. High proportion of the elements being reduced into the alloy and low consumption of electric power. 4. High quality of alloys due to both higher concentration of the alloying elements and a lower slag-and-carbide inclusions therein. 5. Extensive use of the carbothermic process for producing alloys containing both elements which are difficult to reduce (rare earth metals, Ca, Ba, Sr, Zr, Al) and those which are easy to reduce (Mn, Cr). 6. As compared to the carbothermic process, the cost to the alloys being produced is 1.3 to 1.4 times as low.

We claim:

1. A process for the production of silicon-containing ferro alloys utilizing a charge, said charge including an ore comprising an alloying element of the alloy to be obtained, a carbonaceus reducing agent and quartzite, said process comprising the steps of:

(a) mixing said ore and said carbonaceus reducing agent so that the carbon content is from about 1.03 to 1.25 times as low as that sufficient for the reduction of all the elements in the charge and from about 2 to 15 times as high as that sufficient for the reduction of the alloying element;

(b) briquetting the resulting mixture;

(c) adding said quartzite to said briquetted mixture to produce said charge;

(d) charging said resultant charge into a smelting furnace; and (e) carrying a continuous one-stage reduction of the alloying element of the alloy to be produced in said furnace wherein said reduction is carried out with the deficiency of carbon residing in said charge and the excess of carbon residing in said briquetted mixture.

2. A process as set forth in claim 1, wherein the reduction is carried out at a temperature not exceeding 2000° C., the carbon content being 1.25 times as low as that sufficient for the reduction of all the elements in the charge, and 15 times as high as that sufficient for the reduction of the alloying element.

* * * * *